US009955532B2

(12) United States Patent
Matsumoto

(10) Patent No.: US 9,955,532 B2
(45) Date of Patent: Apr. 24, 2018

(54) FABRIC HEATER

(71) Applicant: SANKI CONSYS CO., LTD., Tokyo (JP)

(72) Inventor: Masahide Matsumoto, Tokyo (JP)

(73) Assignee: SANKI CONSYS CO., LTD., Tokyo (JP)

( * ) Notice: Subject to any disclaimer, the term of this patent is extended or adjusted under 35 U.S.C. 154(b) by 350 days.

(21) Appl. No.: 14/363,010

(22) PCT Filed: Dec. 7, 2012

(86) PCT No.: PCT/JP2012/081854
§ 371 (c)(1),
(2) Date: Jul. 31, 2014

(87) PCT Pub. No.: WO2013/085051
PCT Pub. Date: Jun. 13, 2013

(65) Prior Publication Data

US 2014/0374404 A1 Dec. 25, 2014

(30) Foreign Application Priority Data

Dec. 9, 2011 (JP) ..... 2011-270713

(51) Int. Cl.
*H05B 3/34* (2006.01)
*H05B 3/56* (2006.01)
*H05B 3/03* (2006.01)

(52) U.S. Cl.
CPC ..... *H05B 3/345* (2013.01); *H05B 3/03* (2013.01); *H05B 3/56* (2013.01);
(Continued)

(58) Field of Classification Search
CPC ..... H05B 3/03; H05B 3/345; H05B 3/56
(Continued)

(56) References Cited

U.S. PATENT DOCUMENTS 4,792,662 A 12/1988 Kitagaki et al.
5,484,983 A * 1/1996 Roell ..... D04B 1/12 219/528

(Continued)

FOREIGN PATENT DOCUMENTS

CN 1335218 A 2/2002
EP 1197722 A2 4/2002

(Continued)

OTHER PUBLICATIONS

Extended European Search Report, which includes the supplementary European search report and the European search opinion, for the counterpart EP Application, 12855511.7. dated Jul. 17, 2015.

(Continued)

*Primary Examiner* — David Angwin
*Assistant Examiner* — Justin Dodson
(74) *Attorney, Agent, or Firm* — Muncy, Geissler, Olds & Lowe, P.C.

(57) ABSTRACT

To provide a fabric heater that can be stretchable in all direction and warms up quickly. The aforementioned problem is solved by means of a fabric heater (1) that comprises a piece of fabric (2) that is formed into one piece by twist-braiding the plurality of loop portions (5) with each other, the plurality of loops portions (5) being formed by conductive thread (4), and electrodes (30) that are comprised by electrode thread (31, 35) and by spacing from each other, and the conductive thread (4) has a core (10) formed by a fiber and a conductive layer (11) or a conductive foil (12) that covers the surface of the core (10) or; by means of fabric heater (1) which is formed by the conductive thread (4) comprises a bunch of lines (7) having at least one or more conductive lines (6*a*).

9 Claims, 13 Drawing Sheets

(52) U.S. Cl.
CPC .. *H05B 2203/011* (2013.01); *H05B 2203/015* (2013.01); *H05B 2203/036* (2013.01)

(58) Field of Classification Search
USPC ..... 219/212, 215, 538, 542, 543, 544, 549
See application file for complete search history.

(56) References Cited

U.S. PATENT DOCUMENTS

| | | | | |
|---|---|---|---|---|
| 7,560,670 | B2 * | 7/2009 | Lorenzen | H05B 3/342 165/158 |
| 7,759,264 | B2 * | 7/2010 | Braun | A41D 27/06 28/105 |
| 2002/0086204 | A1 | 7/2002 | Rock et al. | |
| 2003/0209003 | A1 * | 11/2003 | Verstraeten | D02G 3/441 57/212 |
| 2004/0057176 | A1 * | 3/2004 | Dhawan | D02G 3/38 361/62 |
| 2005/0150649 | A1 * | 7/2005 | Tsukamoto | F28F 3/022 165/185 |

FOREIGN PATENT DOCUMENTS

| | | | |
|---|---|---|---|
| JP | 61-038791 | U | 3/1986 |
| JP | 01-132088 | A | 5/1989 |
| JP | 04-167389 | A | 6/1992 |
| JP | 1995-161456 | A | 6/1995 |
| JP | 2001-110555 | A | 4/2001 |
| JP | 2004-033730 | A | 2/2004 |
| JP | 2008-108561 | A | 5/2008 |
| JP | 3171497 | U | 10/2011 |
| TW | 201129223 | A1 | 8/2011 |
| WO | 2005/027580 | A1 | 3/2005 |

OTHER PUBLICATIONS

International Preliminary Report on Patentability and an English Version of the Written Opinion of the International Searching Authority of PCT/JP2012/081854.

Notice of Reasons for Refusal of Japanese patent application (JP 2013-540133) Issued Country: Japan dated Oct. 15, 2013.

Notice of Reasons for Refusal of Japanese patent application (JP 2013-540133) Issued Country: Japan dated Jan. 21, 2014.

* cited by examiner

FABRIC HEATER

FIELD OF THE INVENTION

The present invention relates to a fabric heater, and more particularly, to a fabric heater in which an electrode is provided on a fabric which is a knitted fabric.

BACKGROUND ART

A fabric heater is a planar heater in which an electrode is provided on a fabric. Many techniques for such a fabric heater have ever been proposed.

In a heat generating sheet described in Patent Document 1, one obtained by winding a metal line or a strip foil on a string-shaped insulating line is used as a heating line, and a natural fiber or a synthetic fiber is used as an insulating line. This heat generating sheet is constituted by weaving into such a heating line and insulating line and providing an electrode line to form an electric circuit.

A heating element described in Patent Document 2 is a woven fabric which is formed such that a warp and a woof are woven into. In this heating element, a conductive thread is used as a warp, a non-conductive thread is used as a woof, and heat is generated by applying an electric power.

A net-shaped heater described in Patent Document 3 is one formed by tricot knitting in which a plurality of lines for a heater two-dimensionally sews loops continuously in a longitudinal direction. The diameter of the line for a heater is from 0.02 mm to 0.12 mm, and the periphery of the line is coated with enamel. The pitch of stitches of tricot knitting is from 0.5 mm to 5 mm. A net-shaped heater having such a constitution has an effect that the heater can be in a close contact with a curved surface having a complicated shape.

A planar heater described in Patent Document 4 is a technique which was invented by the present applicant. The planar heater described in Patent Document 4 is provided with a first fabric portion and a second fabric portion. The first fabric portion is provided with two first electrode threads. One of the electrode threads is connected to the positive electrode of a battery; the other first electrode thread is connected to the negative electrode of the battery. One first electrode thread and the other first electrode thread are knitted by using interlock stitch. such that they do not cross with each other. In the second fabric portion, a second electrode thread which is a conductor and a heat generating thread which heats when it is energized are knitted by circular knitting. This planar heater is constituted such that an electric current which is flowed out from a battery flows through the one first electrode thread, second electrode thread, heat generating thread, other second electrode thread, and other first electrode thread in the order mentioned, and the heat generating thread is heated.

PRIOR ART REFERENCES

Patent Documents

Patent Document 1: Japanese Laid-Open Patent Application No. 7-161456

Patent Document 2: Japanese Laid-Open Patent Application No. 2004-33730

Patent Document 3: Japanese Laid-Open Patent Application No. 2001-110555

Patent Document 4: Japanese Utility Model Registration No. 3171497

SUMMARY OF THE INVENTION

Problems to be Solved by the Invention

The heat generating sheet described in Patent Document 1 is constituted such that one of a linearly extending heating line and insulating line is oriented in a vertical direction, the other of them is oriented in a lateral direction, and both of them are woven into each other. Likewise, a heating element described in Patent Document 2 is also a woven fabric which is constituted such that a conductive thread is used as a warp, a non-conductive thread is used as a woof, and the warp and the woof are woven into each other. Such a woven fabric is not stretchable.

Since the net-shaped heater described in Patent Document 3 is constituted by knitting a line for a heater by tricot knitting, the net-shaped heater can be extended when a tension is applied thereto. However, since a line for a heater is made of metal, a state in which the net-shaped heater is extended is maintained even after a tension is removed; therefore the extended net-shaped heater cannot be shrunk to the original state. In other words, the net-shaped heater described in Patent Document 3 is not constituted to be freely stretched.

On the other hand, since the fabric of the planar heater described in Patent Document 4 is a knitted fabric, the planar heater can be freely stretched. There are many requests from market for utilizing such a fabric heater having a stretchability. For this reason, the present applicant has been continuously studied a fabric heater which has a higher stretchability than before and whose temperature is quickly raised.

The present invention is made in order to solve the above problems, and aimed at providing a fabric heater which stretches in all directions and whose temperature rises quickly.

Means for Solving the Problems

To solve the problem; a fabric heater according to the present invention has: a piece of fabric that is formed by twist-braiding a plurality of loop portions with each other, the plurality of loop portions being formed by conductive thread; and electrodes that are formed by electrode thread and by spacing from each other; wherein the conductive thread has: a core formed by a fiber; and a conductive layer or conductive foil that covers the surface of the core.

According to the present invention, since a conductive thread comprises a core composed of a fiber and a conductive layer or conductive foil which covers the surface of the core, the conductive thread can be made soft and the temperature of a fabric heater can be quickly raised to a predetermined temperature. Since a fabric is formed by forming a plurality of loops by a flexible conductive thread and by intertwisting the loops with each other to be interknitted, the fabric can have an elasticity and can be freely stretched in all directions.

To solve the problem, the fabric heater according to the present invention has: a piece of fabric that is formed by twist-braiding the plurality of loop portions with each other, the plurality of loop portions being formed by conductive thread; and electrodes that are formed by electrode thread, and by spacing from each other, wherein the conductive thread is formed by a bunch of lines having at least one or more conductive lines.

According to the present invention, since a conductive thread comprises a bunch of lines composed of at least one or a plurality of conductive lines, the conductive thread can be made soft and the temperature of a fabric heater can be quickly raised to a predetermined temperature. Since a fabric is formed by forming a plurality of loops by a flexible conductive thread and by intertwisting the loops with each other to be interknitted, the fabric can have elasticity and can be freely stretched in all directions.

The fabric of the fabric heater according to the present invention is formed into one piece by braiding the conductive thread using interlock stitch so that the conductive thread is braided on one side of the piece of the fabric, and fiber thread only exists on another side of the fabric.

According to the present invention, since the fabric is formed by braiding the conductive thread using interlock stitch so that the conductive thread is braided on one side of the piece of fabric, and fiber thread only exists on another side of the piece of fabric, the one side of the fabric can be functioned as a conductive surface, and the another side of the piece of fabric can be functioned as an insulating surface. The fabric heater according to the present invention; the electrodes are formed by decorative stitch using the electrode thread.

According to the present invention, since the electrodes are formed by decorative stitch using the electrode thread, the electrode can be made flexible. For this reason, the electrode can be deformed in accordance with the deformation of a fabric.

The fabric heater according to the present invention; the electrode thread of the electrodes has twisted thread of copper around a core of the electrode thread formed by the fiber.

According to the present invention, since the core is made of fiber, an electrode thread can be made flexible. For this reason, an electrode thread which is easily sewn into a fabric can be obtained.

In the fabric heater according to the present invention, the electrode comprises a first electrode thread formed by twisting a relatively fine copper line around the core of the electrode thread formed by the fiber and a second electrode thread formed by twisting a relatively bold copper line around the core, wherein the first electrode thread is sewn into from one side of said fabric and the second electrode thread is sewn into from the another side of the fabric.

According to the present invention, since the first electrode thread which is formed by twisting a relatively fine copper line around the core is sewn into on another side of a fabric, electrical adhesion between the first electrode thread and the fabric is improved and the electrode can be made soft. Furthermore, since the second electrode thread which is formed by twisting a relatively bold copper line around the core is sewn into on the one side of a fabric, occurrence of voltage drop can be prevented by securing an electric current which is supplied to the fabric through the relatively bold copper line.

In the fabric heater according to the present invention, only an electrode thread for sewing into the fabric from the one side and an electrode thread for sewing into said fabric from the another side are sewn with each other continuing to the electrode, and the sewn electrode threads are used as a lead line which extends outside the edge of the fabric.

According to the present invention, since the lead line to be connected to an electrode is such that only an electrode thread for sewing into the fabric from the one side and an electrode thread for sewing into the fabric from the another side are sewn with each other continuing to the electrode, and such that the sewn electrode threads extend outside the edge of the fabric, the lead line can be freely stretched. For this reason, even in cases where the positional relationship between a power source and a fabric heater changes, the fabric heater can be used without applying a stress on the fabric heater, lead line, and a portion with which the lead line and fabric heater are connected.

Effect of the Invention

According to the present invention, the fabric heater that stretches in all directions and warms up quickly is obtained.

BRIEF DESCRIPTIONS OF THE DRAWINGS

EMBODIMENTS OF THE INVENTION

In the following, Embodiments of the present invention will be described with reference to the Drawings. It is noted that the technical scope of the present invention should not be limited only to the following description or the Drawings.

[Basic Structure]

Figure 1:
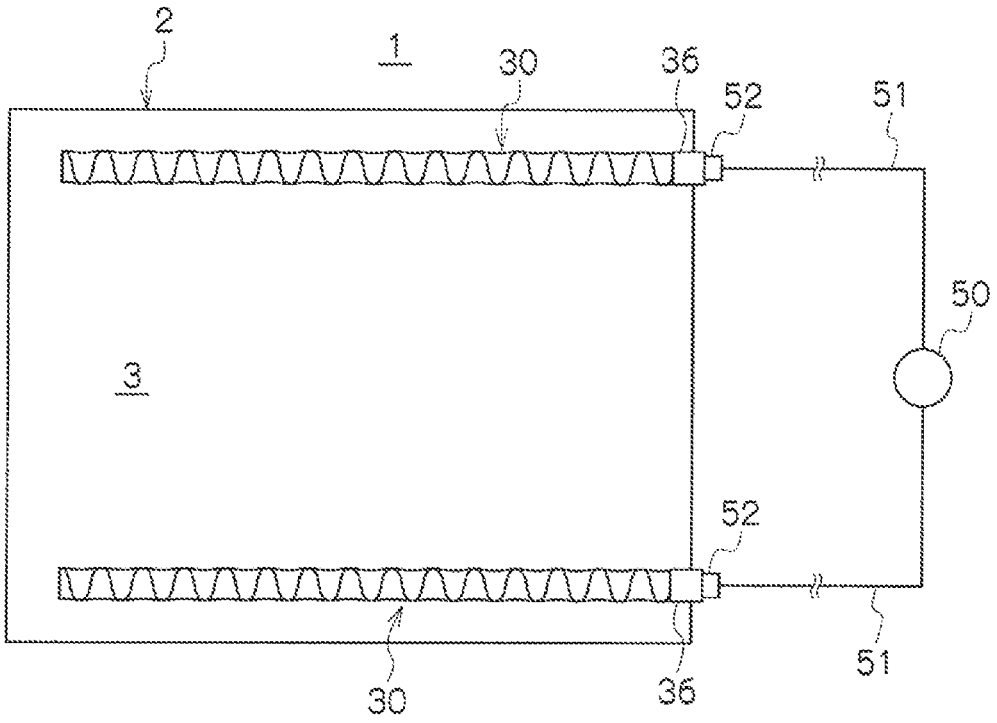
FIG. 1 is a plan view of one side of a fabric heater according to one Embodiment of the present invention.
Figure 2:
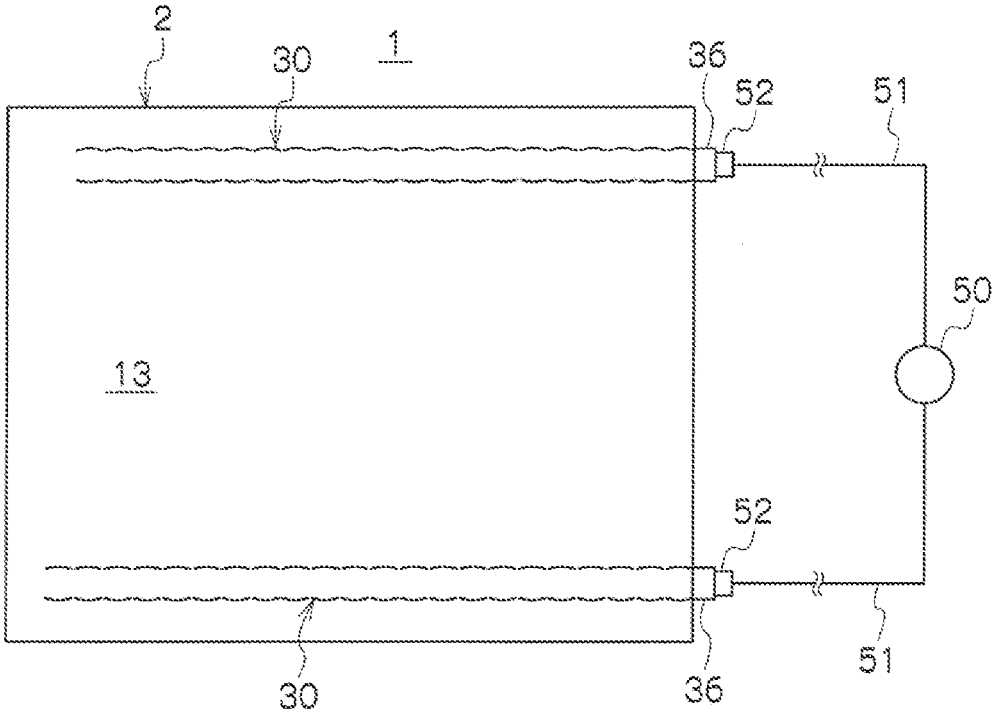
FIG. 2 is a plan view of the other side of the fabric heater illustrated in FIG. 1.
Figure 3:
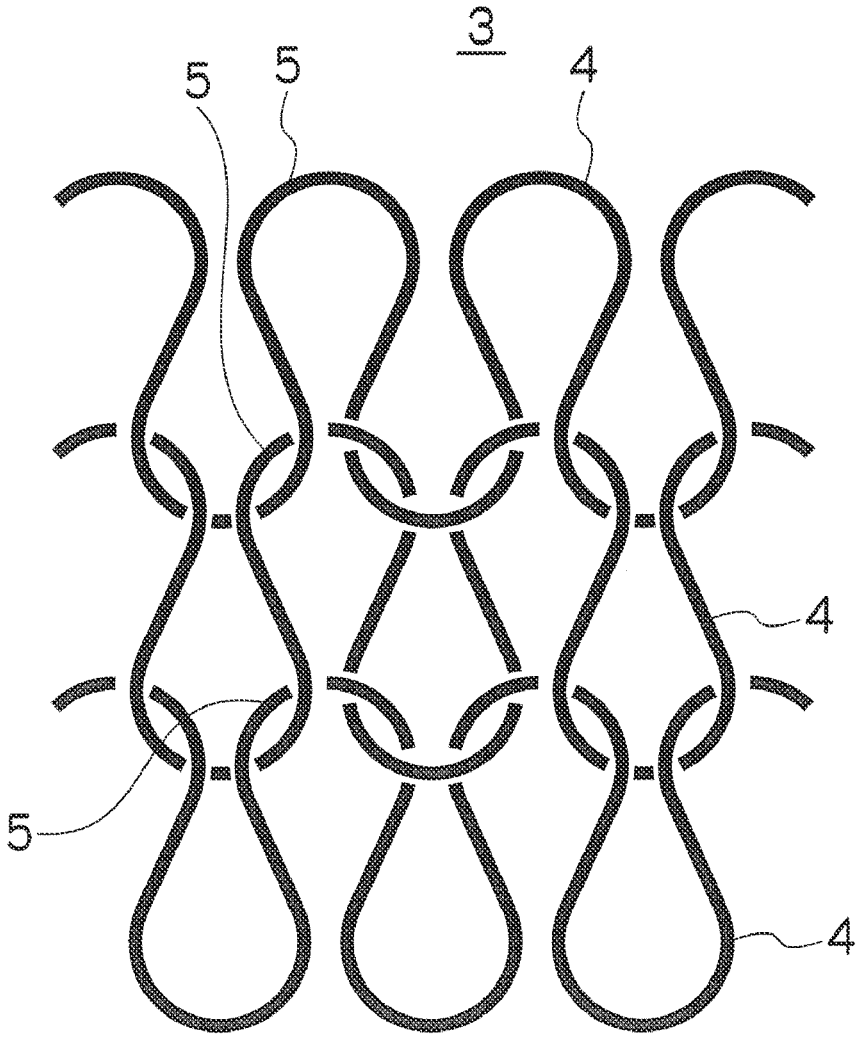
FIG. 3 is an enlarged view schematically illustrating a stitch pattern of a conductive thread.

As illustrated in FIGS. 1 to 3, fabric heater 1 according to the present invention has fabric 2 formed by braiding a plurality of loop portions 5 formed by conductive thread 4 with each other, the loop portions 5, and an electrode thread. Also, fabric heater 1 has electrodes 30 which are provided on fabric 2 with a space therebetween.

Figure 5A:
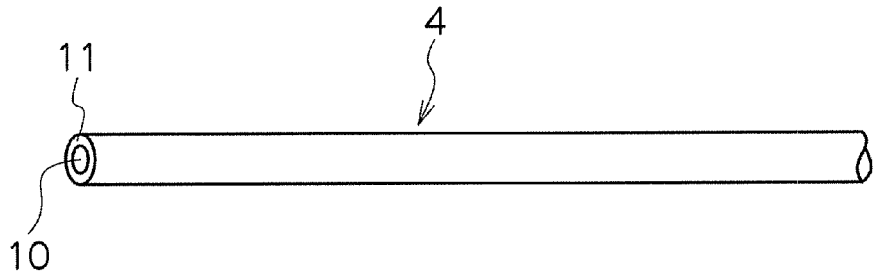
FIGS. 5A and 5B are structural drawings of conductive thread (A) in which the surface of a core is covered with a conductive layer and conductive thread (B) in which the surface of a core is covered with a foil.
Figure 5B:
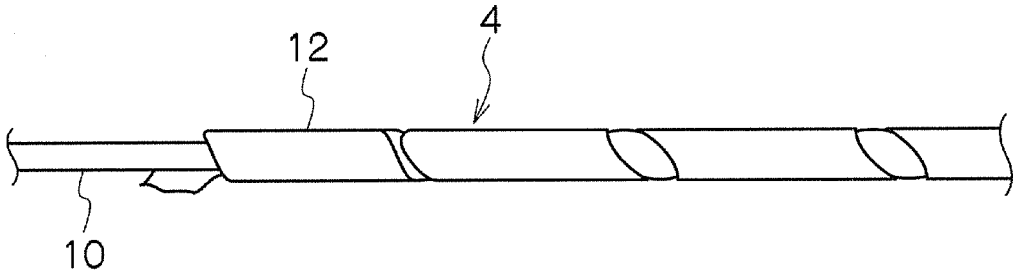
Figure 6A:
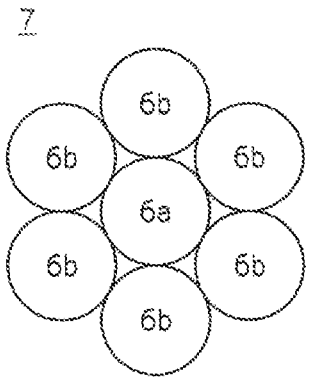
FIGS. 6A-6C are structural drawings of bunch of lines (A) formed by one conductive line and a plurality of non-conductive lines, bunch of lines (B) formed by twisting conductive lines together, and bunch of lines (C) formed by twisting a plurality of non-conductive lines together around a conductive line.
Figure 6B:
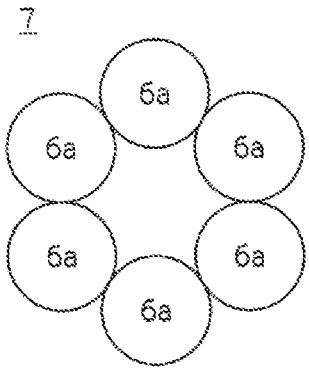
Figure 6C:
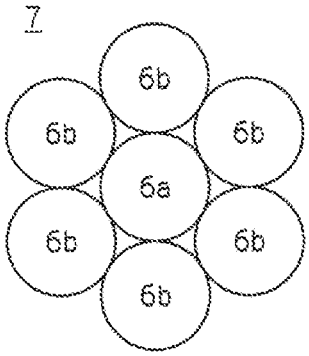

Examples of conductive thread 4 include those of two types of embodiments. As illustrated in FIGS. 5A-5B, first conductive thread 4 comprises core 10 composed of fiber, and conductive layer 11 or conductive foil 12 which covers the surface of core 10. As illustrated in FIGS. 6A-6C, second conductive thread 4 comprises bunch of lines 7 at least including one or a plurality of conductive lines 6*a*.

According to fabric heater 1 according to the present invention, a specific effect that the heater can be made stretchable in all direction and the temperature of the heated can be quickly raised can be attained.

In the following, each component of fabric heater 1 will be described in detail with appropriate reference to the Drawings.

<Fabric>

Figure 4:
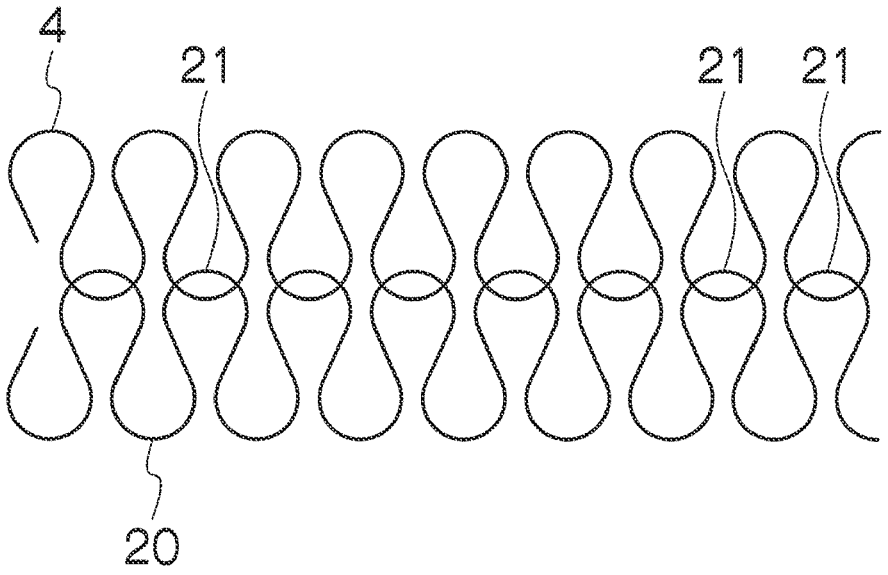
FIG. 4 is an enlarged view schematically illustrating a state in which a thread made of fiber is knitted with respect to a conductive thread by interlock stitch.

In general, fabrics are divided into knitted fabrics which are constituted by forming a plurality of loop portions by a thread and by braiding the loop portions regularly with each other, woven fabrics which are formed by weaving into a thread extending linearly in the longitudinal direction and a thread extending linearly in the lateral direction orthogonal to each other, and others. As illustrated in FIG. 3 and FIG. 4, Fabric 2 which is used for a fabric heater according to the present invention is a knitted fabric.

Examples of embodiments of fabric 2 include those formed by braiding only conductive thread 4, and those formed into one piece by interlock stitch so that the conductive thread 4 is braided on one side 3 of the fabric 2, and the thread 20 made of fiber (hereinafter, referred to as "fiber thread 20") only exists on another side 13 of the fabric 2. In the following, fabric 2 which is formed by braiding the conductive thread 4 using interlock stitch so that the conductive thread 4 is braided on one side 3 of the fabric 2, and the fiber thread 20 only exists on another side 13 will be described as an example.

As illustrated in FIG. 3, a plurality of conductive threads 4 are arranged on one side 3 of fabric 2 with a fixed space. The loop portions 5 are formed toward conductive thread 4 located on upper side of FIG. 3 with a fixed pitch in the length direction. Each conductive thread 4 is formed by braiding these loop portions 5 together.

The knitting method of conductive thread 4 is not particularly limited. Conductive thread 4 may be interknitted by weft knitting or may be interknitted by warp knitting. Examples of weft knitting include jersey knitting, rib knitting (also referred to as "fraise knitting" or "rubber knitting") and pearl knitting (also referred to as "links knitting" or "garter knitting"). Examples of warp knitting include tricot knitting and atlas knitting. The knitting method of conductive thread 4 may be appropriately selected depending on applications or the like of fabric heater 1.

As illustrated in FIG. 4, fiber thread 20 is braided on another side 13. Also, fiber thread 20 is braided by using interlock stitch such that the thread 20 only exists on another side 13. Fiber thread 20 is provided with a plurality of loop 21 with a fixed space therebetween in a direction orthogonal to the direction in which a plurality of conductive threads 4 is knitted. These loop portions 21 are braided so as to be united with conductive thread 4 by being intertwisted with loop portion 5 which is formed on conductive thread 4. The term "interlock stitch" herein refers to a knitting method of braiding in which a thread appearing on one side and a thread appearing on the other side are different from each other.

Specifically, in cases in which conductive thread 4 and fiber thread 20 are interknitted by using conductive thread 4 as a needle thread and by using fiber thread 20 as a bobbin thread, loop 21 of fiber thread 20 is elevated toward conductive thread 4 to be moved above conductive thread 4 by a knitting needle, and thereafter, lowered below conductive thread 4 again by a knitting needle. At this point, loop 21 of fiber thread 20 is intertwisted with loop 5 of conductive thread 4. By repeating this process, loop 21 is connected with conductive thread 4 and a surface of fiber thread 20 is formed on another side 13.

<Conductive Thread>

There are following two types of embodiments of conductive thread 4. Conductive thread 4 according to the first embodiment is composed of core 10 composed of fiber and conductive layer 11 or conductive foil 12 which covers the surface of this core 10. Conductive thread 4 according to the second embodiment comprises bunch of lines 7 at least including one or a plurality of conductive line 6*a*. These two types of embodiments will be described with reference to FIGS. 5A-6C. Conductive thread 4 is preferably one formed by subjecting a conductive thread to an anti-corrosion treatment such as corrosion resistant plating or corrosion resistant enamel coating. The material thereof is not particularly restricted.

(Conductive Thread According to the First Embodiment)

Examples of conductive thread 4 according to the first embodiment include: one which is formed such that core 10 is made of fiber and conductive layer 11 is formed on the surface of core 10 as illustrated in FIG. 5A; and one which is formed such that core 10 is made of fiber and conductive foil 12 is wound on the surface of core 10 as illustrated in FIG. 5B.

Examples of the fiber constituting core 10 include synthetic fiber, natural fiber, and mixed fiber of synthetic fiber and natural fiber. In cases in which core 10 is made of synthetic fiber, core 10 may be made of polyamides or polyesters. Examples of polyamides include nylon, Kevlar (Kevlar is a registered trademark), and Technyl (Technyl is a registered trademark). Examples of polyesters include Tetoron (Tetoron is a registered trademark).

For example, as illustrated in FIG. 5A, conductive layer 11 is formed on the surface of a core 10 by (electroless or electrorytic) plating. Conductive layer 11 is preferably copper, copper alloy, silver, silver alloy, or the like, which has a high conductivity.

Foil 12 is a strip member and is wound on the surface of core 10 so as to spirally extend in the length direction of core 10. Whole surface of core 10 is covered with this foil 12. For foil 12, for example, one made of 0.3 mass % tin-containing copper alloy is used.

For such foil 12, one having a thickness and width adapted to the type of core 10 to be used is used. For example, in a case in which core 10 which is made of polyester having a fineness of 56 denier is covered with foil 12, foil 12 which is formed to have a thickness of 12 μm and a width of 170 μm is used. In a case in which core 10 which is made of polyester having a thickness of 250 denier is covered with foil 12, foil 12 which is formed to have a thickness of 27 μm and a width of 320 μm is used.

Conductive thread 4 may be formed of bunch of lines formed by twisting a plurality of lines composed of core 10 composed of fiber and conductive layer 11 or conductive foil 12 which covers the surface of this core 10.

(Conductive Thread According to the Second Embodiment)

Conductive thread 4 according to the second embodiment is constituted by bunch of lines 7 at least including one or a plurality of conductive lines 6*a* as illustrated in FIGS. 6A-6C. Examples of bunch of lines 7 include one which is constituted by conductive line 6*a* and non-conductive line 6*b*, and one which is constituted only by conductive line 6*a*. The number of sum of conductive line 6*a* and non-conductive line 6*b* is not restricted as long as bunch of lines 7 includes at least one conductive line 6*a*.

Bunch of lines 7 illustrated in FIG. 6A is constituted such that one conductive line 6*a* is provided at the center and six non-conductive lines 6*b* are arranged therearound. Six non-conductive lines 6*b* are arranged around conductive line 6*a* in parallel to each other without being twisted together. Bunch of lines 7 may be formed by arranging conductive line 6*a* and non-conductive line 6*b* around conductive line 6*a*. Bunch of lines 7 may be formed such that non-conductive line 6*b* is provided at the center and conductive lines 6*a* are arranged therearound. In cases in which non-conductive line 6*b* is provided at the center, bunch of lines 7 may be formed such that conductive line 6*a* and non-conductive line 6*b* are arranged around non-conductive line 6*b*.

Bunch of lines 7 illustrated in FIG. 6B is formed by twisting only a plurality of conductive line 6*a* together. It is noted that bunch of lines 7 is not limited to one formed by twisting only conductive line 6*a* together, and may be one formed by twisting conductive line 6*a* and non-conductive line 6*b*.

Bunch of lines 7 illustrated in FIG. 6C is constituted such that one conductive line 6*a* is provided at the center and six non-conductive lines 6*b* are arranged therearound. Six non-conductive lines 6*b* are twisted together to extend spirally around conductive line 6*a*. Bunch of lines 7 may be formed by arranging conductive line 6*a* and non-conductive line 6*b* around conductive line 6*a*. Bunch of lines 7 may be formed such that non-conductive line 6*b* is provided at the center and conductive lines 6*a* are arranged therearound. In cases in which non-conductive line 6*b* is provided at the center, bunch of lines 7 may be formed such that conductive line 6*a* and non-conductive line 6*b* are arranged around non-conductive line 6*b*. Bunch of lines 7 may be constituted only by conductive line 6*a*.

Although not illustrated, bunch of lines 7 may be formed by further twisting a plurality of lines having a structure illustrated in FIG. 6C. Further, bunch of lines 7 may be formed by interknitting conductive line 6*a* and non-conductive line 6*b*.

For conductive line 6*a*, for example, a tin-containing copper alloy is used. For example, when the line is formed by using 0.3 mass % tin-containing copper alloy, a suitable fabric heater 1 can be formed. It is noted that conductive line 6*a* is not limited to a tin-containing copper alloy as long as it is conductive, and can be made of a variety types of materials. Although, for conductive line 6*a*, one which is formed to have a line diameter according to the purpose of use can be selected and used, in fabric heater 1 of the present Embodiment, conductive line 6*a* which is formed to have a line diameter of 25 μm is selected and used.

A plating film (electroless or electrolytic) may be provided as needed. The plating film preferably has a corrosion resistance. For example, a material having a corrosion resistance such as silver, tin, nickel, or an alloy thereof is used.

For example, the outer diameter of conductive thread 4 according to the second embodiment is about 75 μm when bunch of lines 7 silver plating formed on the surface of bunch of lines 7 formed by twisting seven lines 6 of 25 μm in diameter is used as core 10.

<Fiber Thread>

For fiber thread 20, any of synthetic fiber, natural fiber, and mixed fiber of synthetic fiber and natural fiber can be used. In cases in which fiber thread 20 is made of synthetic fiber, fiber thread 20 may be made of polyamide or polyester. Examples of polyamides include nylon, Kevlar (Kevlar is a registered trademark) and Technyl (Technyl is a registered trademark). Examples of polyesters include Tetoron (Tetoron is a registered trademark). For such fiber thread 20, for example, a thread which is formed to have a thickness of 30 denier is used, and a thread having a suitable thickness according to the purpose of use is selected.

<Electrode>

Electrodes 30 are provided on fabric 2 at two locations. Electrodes 30 which are provided on two locations have a predetermined space therebetween. Electrodes 30, however, can be provided at two or more locations as long as the function of fabric heater 1 is not inhibited. For such electrode 30, any of an embodiment in which an electrode is formed by sewing an electrode thread into fabric 2, an embodiment in which electrode 30 which is formed in a predetermined shape in advance is attached to fabric 2 with an adhesive or bonded using a bonding member such as a stapler, an embodiment in which an electrode is formed such that an electrode thread is partly interknitted into fabric 2 in a process of interknitting fabric 2, and the like may be selected as needed. Electrode 30 will be described taking the embodiment in which an electrode is formed by sewing an electrode thread into fabric 2 as an example.

There are two types of embodiments when electrode 30 is formed by sewing an electrode thread into fabric 2: an embodiment in which an electrode thread is sewn into fabric 2 such that electrode 30 does not deform according to stretching of fabric 2; and an embodiment in which an electrode thread is sewn into fabric 2 such that electrode 30 freely deforms following stretching of fabric 2. In cases in which an electrode thread is sewn into fabric 2 such that electrode 30 freely deforms following stretching of fabric 2, electrode 30 may be constituted by a sewing method called decoration sewing in which a stitch deforms according to deformation of fabric 2.

In the case of fabric 2 which is formed by braiding only conductive thread 4, any of embodiments of decorative sewing: decorative sewing of an embodiment in which decorative portions appear on both sides of fabric 2; and decorative sewing of an embodiment in which a decorative portion appears only on one side of fabric 2 can be utilized. On the other hand, in the case of fabric 2 which is formed into one piece by braiding the conductive thread 4 using interlock stitch so that the conductive thread 4 is braided on one side 3, and fiber thread 20 only exists on another side 13. Electrode 30 may be formed by decoratively sewing on one side 3 in which a decorative portion is formed on one side 3 on which conductive thread 4 appears. In cases in which decorative sewing is conducted, a plurality of needles, for example, two to four needles are used.

First electrode thread 31 to be used for a needle thread (hereinafter, simply referred to as "electrode thread 31") and second electrode thread 35 to be used for a bobbin thread (hereinafter, simply referred to as "electrode thread 35") are formed by twisting a copper line 31*b*, 35*b* on the outer periphery of a core line 31*a*, 35*a* composed of fiber, respectively. Electrode thread 31 is formed by twisting a copper line 31*b* whose diameter $D_1$ is relatively small on the outer periphery of a core line 31*a*; and electrode thread 35 is formed by twisting a copper line 35*b* whose diameter $D_2$ is relatively large on the outer periphery of a core line 35*a*. Specifically, electrode thread 31 is formed by twisting a copper line 31*b* having an outer diameter $D_1$ of 0.05 mm or smaller on the outer periphery of a core line 31*a*; and electrode thread 35 is formed by twisting a copper line 35*b* having an outer diameter $D_2$ of 0.08 mm or larger on the outer periphery of a core line 35*b*. Electrode thread 31 improves the electrical adhesion with fabric 2 and softens electrode 30. On the other hand, electrode thread 35 prevents voltage drop by securing an electric current to be supplied to fabric 2.

For the core fiber constituting electrode thread 31 and electrode thread 35, any of synthetic fiber, natural fiber, and mixed fiber of synthetic fiber and natural fiber can be used. In cases in which a core is made of synthetic fiber, the core may be made of polyamides or polyesters. Examples of polyamides include nylon, Kevlar (Kevlar is a registered trademark), and Technyl (Technyl is a registered trademark). Examples of polyesters include Tetoron (Tetoron is a registered trademark).

However, for electrode threads 31, 35, other than one which is formed by twisting a conducting line on a core fiber composed of fiber, one formed by forming a corrosion resistant plating film on the surface of a conductive line can also be used. Materials for forming such a corrosion resistant plating film are materials having corrosion resistance such as silver, tin, nickel or alloys thereof. The electrode threads may be constituted only by a copper line or a copper alloy line without applying a corrosion resistant plating film according to the purpose of use.

Figure 7A:
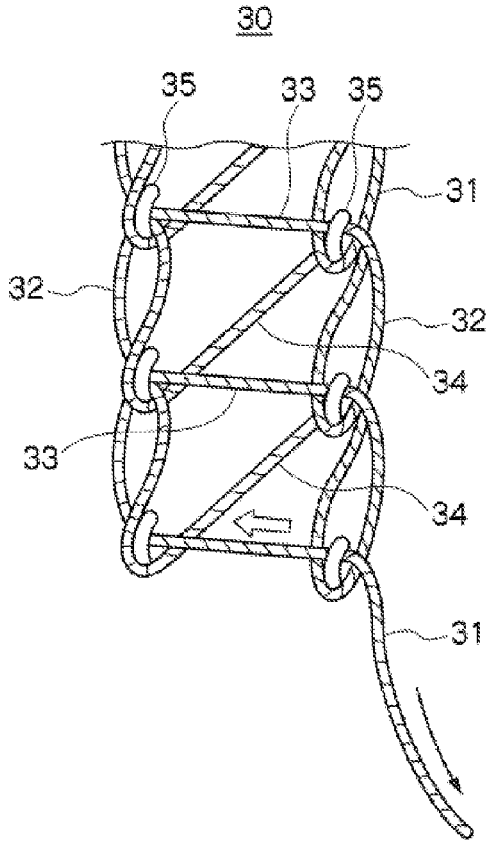
FIG. 7A is a perspective view illustrating a state in which an electrode thread is decoratively sewn on one side.
Figure 7B:
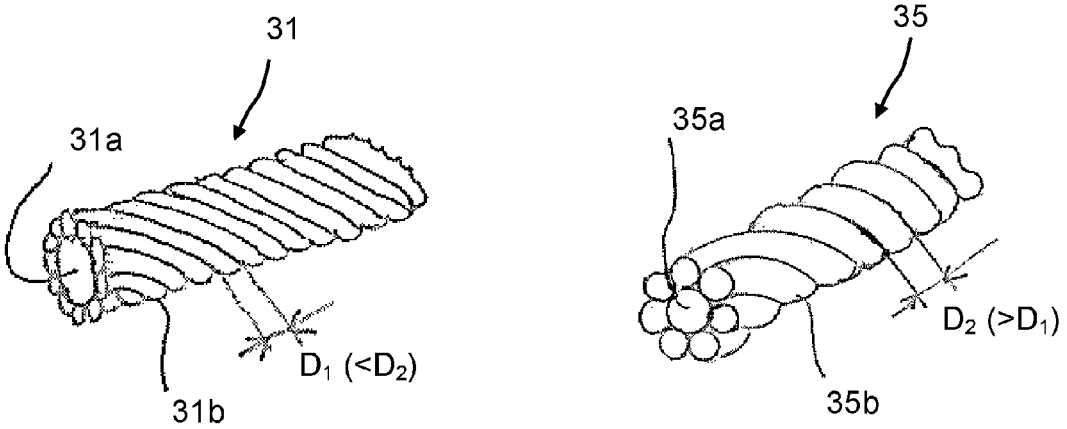
FIG. 7B is a perspective enlarged view of portions of first and second electrode threads forming the electrode shown in FIG. 7A.
Figure 8:
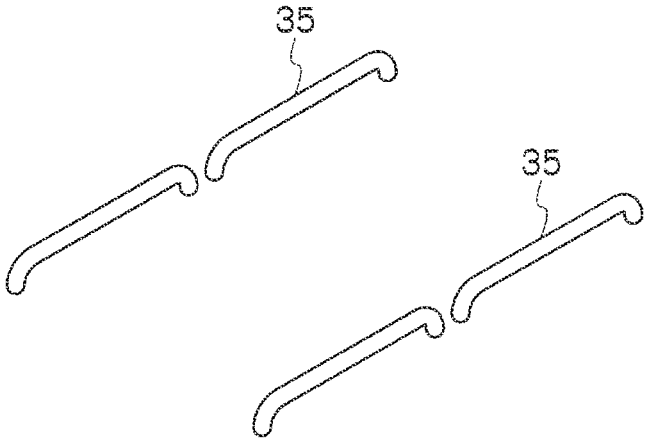
FIG. 8 is a perspective view illustrating a state of a bobbin thread which maintains the shape of the electrode thread which is decoratively sewn on one side.
Figure 9:
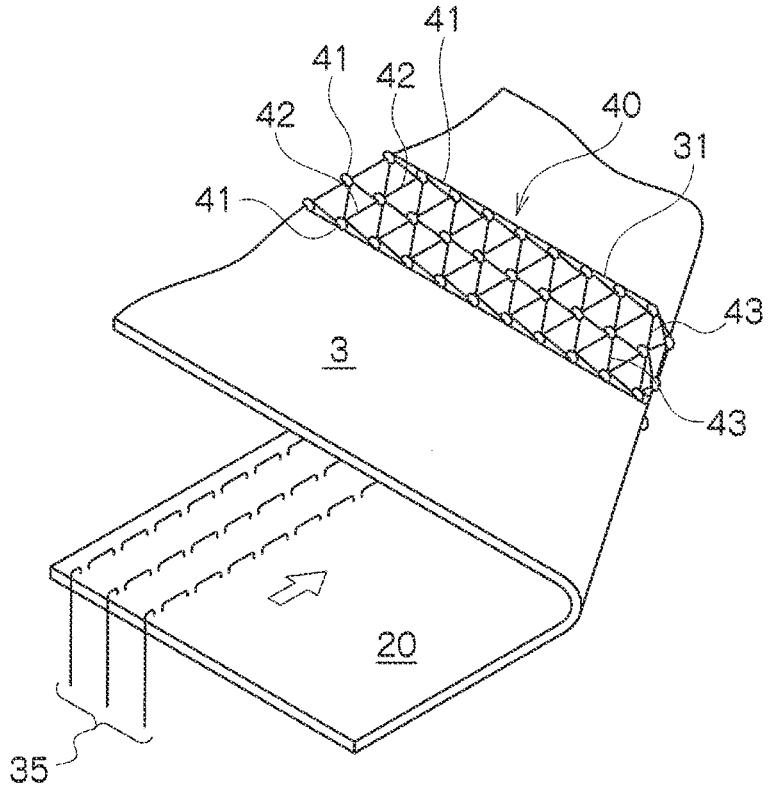
FIG. 9 is a perspective view illustrating states of an electrode thread which is decoratively sewn on one side of another embodiment different from those in FIGS. 7A and 8 and a bobbin thread.

Regarding such electrode 30 which is constituted by electrode threads 31, 35, electrode 30 which is formed by using two needles is described with reference to FIGS. 7A and 8, and electrode 40 which is formed by using three needles is described with reference to FIG. 9.

First, electrode 30 which is formed by using two needles is described. For electrode 30, electrode thread 31 is used as a needle thread, and electrode thread 35 is used as a bobbin thread. Electrode thread 31 which is a needle thread is, as illustrated in FIG. 7A, sewn into fabric 2 such that alphabetic characters "Z"s are laid in a row on one side 3 on which conductive thread 4 is interknitted. Electrode thread 31 which is sewn into comprises: portions 31 which are parallel to each other; portion 32 which is orthogonal to portions 31 which are parallel to one another and has one end connecting to one of portions 31 and another end connecting to another one of portions 31; and portion 33 which has one end connecting to one of portions 41 and another end connecting to another one of portions 41 such that the portion obliquely crosses portions 31 which are parallel to one another. The shape of electrode thread 31 which is sewn into is maintained by being fixed by electrode thread 35 which is a bobbin thread at portions 32 which are parallel to each other for each fixed space in the sewing direction.

Two electrode threads 35 which are bobbin threads are used. As illustrated in FIG. 8, electrode threads 35 extend in the sewing direction in parallel to each other to form broken lines at locations corresponding to portions 32 of electrode thread 31 which are parallel to each other on another side 13 on which fiber thread 20 is interknitted.

Next, electrode 40 which is formed using three needles is described with reference to FIG. 9.

Electrode thread 31 which is a needle thread is sewn into one side 3 such that the electrode thread has: three portions 41 which are parallel to one another; portion 42 which is orthogonal to portions 41 which are parallel to one another and has one end connecting to one of portions 41 and another end connecting to another one of portions 41; and portion 43 which has one end connecting to one of portions 41 and another end connecting to another one of portions 41 such that the portion obliquely crosses portions 41 which are parallel to one another. The shape of electrode thread 31 which is sewn into is maintained by being fixed by electrode thread 35 which is a bobbin thread at each of portions 41 which are parallel to each other for each fixed space in the sewing direction.

Three electrode threads 35 which are bobbin threads are used. Electrode threads 35 extend in the sewing direction in parallel to one another to make broken lines at locations corresponding to the portions of electrode thread 31 which are parallel to one another on another side 13 on which fiber thread 20 is interknitted.

In cases in which an electrode 30 is formed by decoratively sewing using four needles, there are four portions which are parallel to one another. Four electrode threads 35 which are bobbin threads are used and sewn into to form wave lines such that four electrode threads 35 extend in the sewing direction.

Since such electrode 30 is formed by decoratively sewing electrode threads 31, 35 on one side, electrode 30 itself stretches according to stretching of fabric 2. It is noted that electrode 30, 40 in which electrode thread 31 and electrode thread 35 are used is not restricted to be applied to fabric 2 which is formed into one piece by braiding the conductive thread using interlock stitch so that the conductive thread 4 is braided on one side 3, and fiber thread 20 only exists on another side 13. Electrode 30, 40 which is formed by electrode thread 31 and electrode thread 35 are used can also be applied to a fabric 2 which is formed by branding only conductive thread 4.

The electrode may be formed by using an electrode thread for a needle thread and using a thread composed of fiber for a bobbin thread. In this case, the electrode may be constituted in a similar structure to that of the above-described electrode 30, 40.

Figure 10:
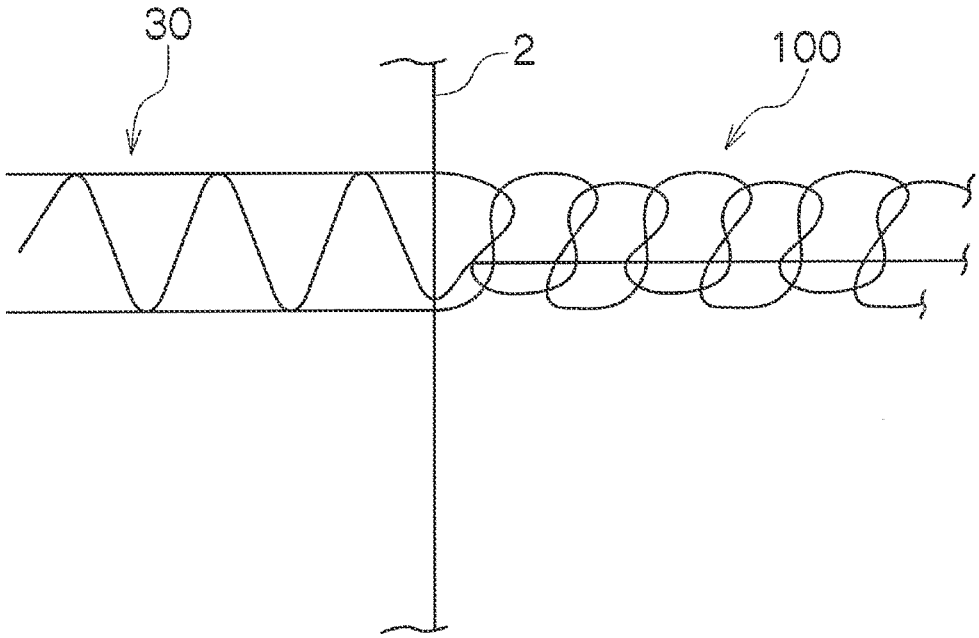
FIG. 10 is an explanatory drawing schematically illustrating a stretchable lead line which is provided continuing to an electrode.

Wiring for connecting to a power source or the like is connected to this electrode 30. Lead line 100 illustrated in FIG. 10 is one type of such wiring. Those in which only thread for sewing into fabric 2 from one side 3 of fabric 2 and a thread for sewing into fabric 2 from another side 13 of fabric 2 extend outside the edge of fabric 2 like a chain are called "kara-kan (void ring)" in Japan.

Lead line 100 is, as illustrated in FIG. 10, electrode thread 31 for sewing into fabric 2 from one side 3 of fabric 2 and electrode thread 35 for sewing into the fabric from another side 13. Electrode thread 31 and electrode thread 35 used as lead line 100 contacts to electrode 30 and are sewn with each other outside the edge of fabric 2. Electrode 30 is formed by performing a process in which is sewn into fabric 2 with an overlock sewing machine (not illustrated) using electrode threads 31, 35. This lead line 100 is formed in a process in which electrode 30 is sewn into fabric 2 with an overlock sewing machine (not illustrated) using electrode threads 31, 35. The lead line 100 is formed by stitching up only the electrode thread 31, 35 each other after sewing electrode threads 31, 35 to the edge of fabric 2, and in a state where fabric 2 is moved from the position of a sewing machine needle and only electrode threads 31, 35 are sewn with each other without inserting fabric 2 in between to form lead line 100. Such lead line 100 has stretchability; therefore, for example, in cases in which fabric heater 1 is used in an embodiment in which the position of fabric heater 1 with respect to that of a power source moves, lead line 100 stretches following the movement of fabric heater 1 when fabric heater 1 and the power source are connected with each other by lead line 100.

Fabric 2 which is formed by interknitting conductive thread 4 and fiber thread 20 as described above has a stretchability of 20% to 200% in all directions. In cases in which electrode 30, 40 is provided by decoratively sewing, electrode 30, 40 deforms following stretching of fabric 2. Fabric heater 1 with such characteristics can be mounted on a target object whose shape changes while maintaining a state of close contact. Further, fabric heater 1 can be mounted closely on a target object whose shape is complicated.

As illustrated in FIGS. 1 and 2, fabric 2 of fabric heater 1 is heated by connecting power source 50 to electrode 30 and applying a voltage across electrodes 30 by power source 50.

(Power Source)

For power source 50, any of DC power source and AC power source may be used. In cases in which a DC power source is used, power source 50 which outputs a voltage of DC 1.5 V or higher and DC 25 V or lower may be used. In such cases, examples of power source 50 include a dry battery and a lithium polymer battery. Further, for power source 50, a voltage stabilizer in which an AC power source of AC100 V or AC200 V is converted to a direct electric current of, for example, DC 1.5 V or higher and DC 25 V or lower by an AC/DC adapter and the converted direct electric current is output can be used. Still further, for power source 50, an AC power source or a power source which outputs a pulse voltage can be used. In the following, an embodiment of connection between fabric heater 1 and power source 50 and an effect of fabric heater 1 will be described with reference to FIGS. 1 and 2, taking a case in which a DC power source is used as power source 50 as an example.

FIGS. 1 and 2 illustrate one example of an embodiment of connection between power source 50 which is a DC power source and fabric heater 1. As illustrated in FIGS. 1 and 2, power source 50 comprises wiring 51 extending to each of electrodes 30. Each wiring 51 comprises connector 52 at its end. This connector 52 is detachably constituted to be detachable from connector 36 provided on electrode 30.

In cases in which lead line 100 which extends from electrode 30 is provided, lead line 100 is utilized as a stretchable wiring. In this case, fabric heater 1 is connected to power source 50 by directly connecting lead line 100 to power source 50 or by providing connector 36 on the end of lead line 100 and connecting this connector 36 to connector 52.

Next, principles on which fabric heater 1 works as a heater are described. When a voltage is applied to electrode 30, an electric current is carried across electrodes 30 by conductive thread 4 which is interknitted on one side of fabric 2. Fabric 2 constituting fabric heater 1 provides a fixed resistance value across electrodes 30. A Joule heat according to the resistance value is thus generated on fabric 2 across electrodes 30. A Joule heat to be generated is represented by the following formula (1), setting the Joule heat to P, the value of electric current to I, and the resistance value across electrodes 30 to R.

$$P\ (\text{watt}) = I \times I \times R \quad (1)$$

Since the temperature of fabric heater 1 is defined by a Joule heat generated from fabric 2, a resistance value across electrodes 30 and a voltage to be applied across electrodes 30 are determined according to a temperature to be attained. A fixed voltage may be applied continuously, or a voltage may be appropriately applied by repeating an on/off operation by using a controller which is not illustrated. Since fiber thread 20 is interknitted on another side 13 of fabric 2, fiber thread 20 functions as an insulator and another side 13 is electrically insulated.

Conductive thread 4 which constitutes fabric 2 has a structure composed of core 10 composed of fiber and conductive layer 11 or foil 12 which covers the surface of this core 10 as illustrated in FIGS. 5A and 5B, or a structure which is constituted by bunch of lines 7 including one or a plurality of conductive lines 6*a* as illustrated in FIGS. 6A-6C. Since conductive thread 4 has such a structure as illustrated in FIGS. 5A-6C, the temperature of fabric heater 1 is elevated to a predetermined temperature in a short time when a voltage is applied across electrodes 30. Since fabric 2 is constituted by interknitting conductive thread 4, the temperature of an area between electrodes 30 is uniformly elevated. Since fiber thread 20 is interknitted on another side 13 of fabric 2, another side 13 functions as an insulating surface.

For example, when a voltage of 18.9 V was applied across electrodes 30 of fabric heater 1 which was formed to have a length of 1300 mm and a width of 100 mm, an electric current 1.65 A was applied across electrodes 30, and a Joule heat (watt density: 0.024 W/cm$^2$) of 31.2 W was generated from fabric heater 1, it was confirmed that the temperature of whole fabric heater 1 was elevated by about 20° C. in two minutes.

Since the above-described fabric heater 1 has a stretching ratio of 20% to 200%, fabric heater 1 can be used for a desired portion of a variety of target objects such as human bodies, animals, or structures in cases in which fabric heater 1 is mounted thereon to keep the desired portion warm. Fabric heater 1 can be utilized for a protection against cold by using fabric heater 1 for a glove or a scarf. In cases in which fabric heater 1 is utilized for such applications, fabric heater 1 is used by being formed into an appropriate shape according to an object to be kept warm such as a strip.

In cases in which human bodies or animals are partly kept warm, fabric heater 1 is used by wrapping a portion of human bodies or animals to be kept warm. This is particularly effective in cases in which fabric heater 1 is mounted on a portion where an embodiment changes such as a joint portion of human bodies or animals. Although an embodiment of a joint portion changes, since fabric heater 1 stretches, fabric heater 1 can follow changes in the embodiment of the joint portion and can effectively prevent interruption of actions of human bodies or animals.

Also in cases in which a structure is partly kept warm at a fixed temperature, fabric 2 is used by being wound on a desired portion. In such cases, since fabric heater 1 stretches, fabric heater 1 deforms so as to follow the shape of a target to be kept warm, and a gap is not formed between fabric heater 1 and a target to be kept warm. This is particularly effective in cases in which a portion of a complicated shape is kept warm. Fabric heater 1 stretches to deform according to the shape of a target to be kept warm and can be mounted in close contact with a portion of a target to be kept warm.

Cases in which conductive thread 4 is plated with silver or the like or covered with a copper foil or the like are preferred since fabric heater 1 can be provided with an effect of preventing occurrence of static electricity and with an antibacterial action.

EXAMPLES

By using a test sample manufactured by using fabric 2 constituting fabric heater 1 of the present invention and a test sample for comparison, a confirmation test of stretchability and a confirmation test of temperature rise were performed as follows.

[Confirmation Test of Stretchability]

Figure 11:
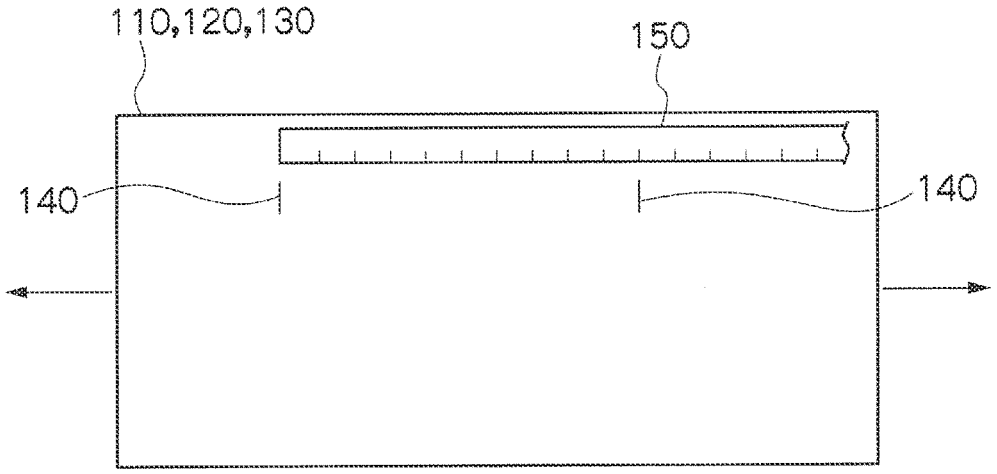
FIG. 11 is an explanatory drawing of a confirmation test for stretchability.

As illustrated in FIG. 11, a confirmation test of stretchability was performed by using: test sample 110 formed by using fabric 2 constituting fabric heater 1 according to the present invention; test sample 120 for comparison formed by using a stainless mesh; and test sample 130 for comparison formed by weaving into carbon fiber.

Test sample 110 was formed by interknitting conductive thread 4 formed by plating a core 10 composed of nylon with silver and fiber thread 20 composed of nylon. Specifically, test sample 110 was interknitted by interlock stitch in which conductive thread 4 was interknitted on one side 3 and fiber thread 20 appeared only on the another side 13.

For test sample 120, one which was formed by a 40 mesh stainless mesh in which a stainless line with a diameter of 0.18 mm was weaved in plain weave to have an aperture of 0.455 mm and an aperture ratio of 51.0% was used. For test sample 130, one which is formed such that the diameter of fiber is 7.0 μm and the density was 1.78 g/cm$^3$ was used.

In the confirmation test, as illustrated in FIG. 11, a tension was applied to each of test samples 110, 120, 130 and each of test samples 110, 120, 130 was drawn in one direction and it was confirmed whether each test sample extended. Then the tension was removed and it was confirmed whether each test sample returned to its original state. A specific confirmation was performed by marking two marks 140 was made for each test sample 110, 120, 130 in an interval between 100 mm 0, and by measuring the space between the two marks 140. The measurement of the space between the two marks 140 was performed by visual inspection applying measure 150 provided with a scale in close proximity to two marks 140.

[Test Result]

In test sample 110, a space between two marks 140 extended to be about 125 mm when a tension was applied to the test sample. When the tension was removed, the space between two marks 140 became about 98 mm. In other words, the stretching ratio of test sample 110 was about 25%. In contrast, in test sample 120, although a space between two marks 140 extended to some degree when a tension was applied, the test sample 120 maintained the extended state without shrinking the space between two marks 140 even after removing the tension. In test sample 130, the space between two marks 140 hardly expanded even when a tension was applied to the test sample.

As seen from the above test results, fabric 2 constituting fabric heater 1 according to the present invention extended when a tension was applied to fabric 2, and fabric 2 was restored to its original state when the tension was removed. In other words, fabric 2 constituting fabric heater 1 according to the present invention freely stretched. It was confirmed that the stretching ratio of fabric 2 was 20% or higher although depending on the tension.

[Confirmation Test of Temperature Rise]

The confirmation test of temperature rise was performed by using test sample 210 for a test which was manufactured by using fabric 2 and test sample 220 for a test which was formed by weaving into carbon fiber.

Test sample 210 was formed by interknitting conductive thread 4 formed by plating a core line composed of nylon with silver and fiber thread 20 composed of nylon. Specifically, test sample 210 is formed by braiding the conductive thread using interlock stitch so that the conductive thread is braided on one side 3 of fabric 2, and fiber thread only exists on another side 13 of the fabric 2.

Test sample 220 was formed by weaving into seven carbon fibers in parallel in which the number of filament was 1000, the diameter of the fiber was 7.0 μm, the density was 1.78 g/cm$^3$, and the volume resistance value was $1.6\times10^{-3}$ Ω·cm$^3$ and which were formed to have a size of 35 mm in the longitudinal direction and 90 mm in the lateral direction.

Test samples 210, 220 were heated by providing two electrodes on each of test samples 210, 220 with a fixed space between the two electrodes and applying an DC voltage of 3.0 V across the electrodes.

The temperature measurement was performed by a far-infrared imaging utilizing a principle of an infrared radiation thermometer in which the amount of far-infrared radiated from the surface of each of test samples 210, 220 was measured by a detector. For a measurement apparatus, T335 manufactured by FLIR Systems, Inc. was used; for an analysis software, Quick Plot manufactured by FLIR Systems, Inc. was used. The temperature measurement was performed for three points on each of test samples 210, 220.

[Test Result]

Figure 12:
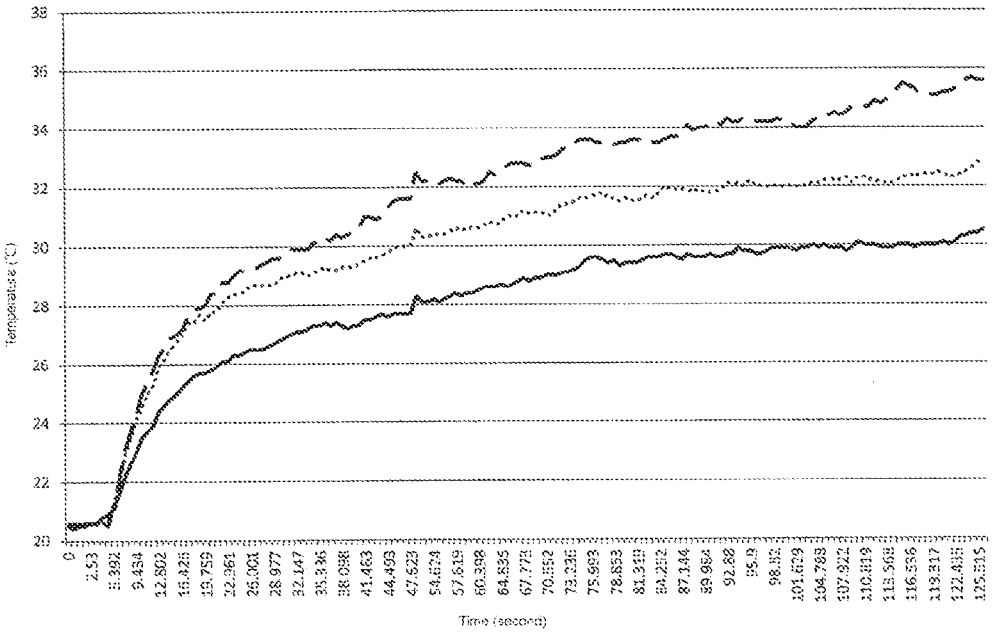
FIG. 12 is a graph illustrating a change in temperature rise of a test sample which is made of a fabric constituting a fabric heater according to the present invention.
Figure 13:
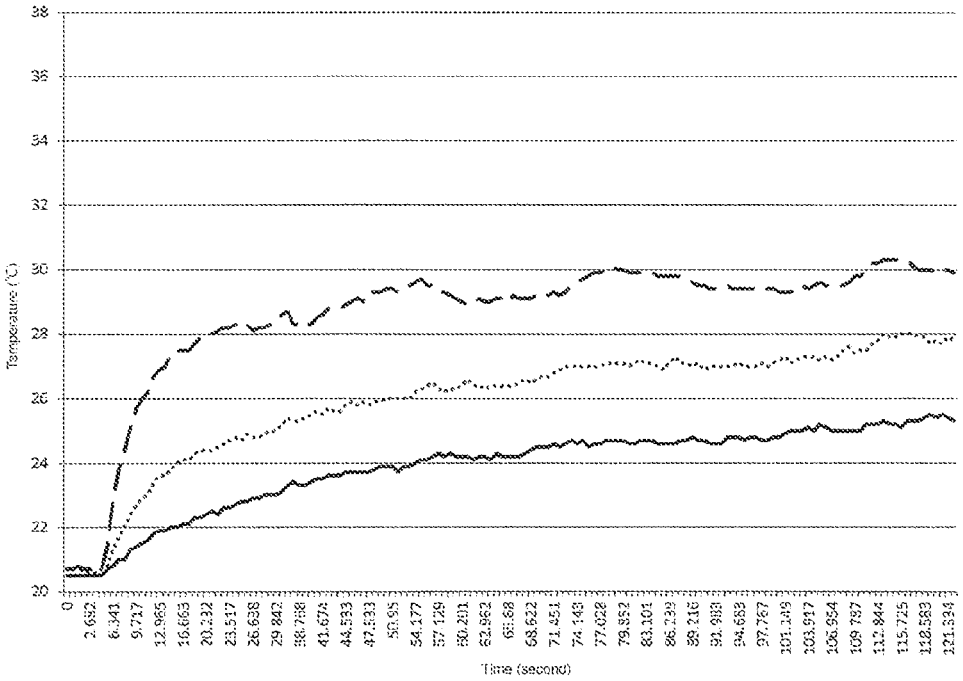
FIG. 13 is a graph illustrating a change in temperature rise of a test sample for comparison.

FIG. 12 illustrates the result of the temperature measurement of test sample 210, and FIG. 13 illustrates the result of the temperature measurement of test sample 220. In FIGS. 12 and 13, the horizontal axis represents time (second), and the vertical axis represents temperature (° C.). In FIGS. 12 and 13, for each of test samples 210, 220, a solid line represents a change in temperature rise at a first measuring point where the temperature rises relatively slowly, a dotted line represents a change in temperature rise at a second measuring point where the temperature rises somewhat quickly, and a wave line represents a change in temperature rise at a third measuring point where the temperature rises quickly.

As illustrated in FIG. 12, the temperatures at the first measuring point to the third measuring point of test sample 210 were about 20° C. at a point in time before a voltage was applied. The temperatures at the first measuring point to the third measuring point of test sample 210 started to rise about five seconds after a voltage was applied. Sixty seconds after a voltage was applied, the temperature at the first measuring point was above 28° C., the temperature at the second measuring point was above 30° C., and the temperature at the third measuring point rose to about 32° C. A hundred and twenty seconds after a voltage was applied, the temperature at the first measuring point was about 30° C., the temperature at the second measuring point was above 32° C., and the temperature at the third measuring point rose to about 35° C.

As illustrated in FIG. 13, the temperatures at the first measuring point to the third measuring point of test sample 220 were about 20° C. at a point in time before a voltage was applied. The temperatures at the first measuring point to the third measuring point of test sample 220 started to rise about five seconds after a voltage was applied. However, sixty seconds after a voltage was applied, the temperature at the first measuring point rose to as low as about 24° C., the temperature at the second measuring point rose to a temperature as low as above 26° C., and the temperature at the third measuring point rose to as low as about 29° C. A hundred and twenty seconds after a voltage was applied, the temperature at the first measuring point rose to a temperature as low as below 26° C., the temperature at the second measuring point rose to as low as about 28° C., and the temperature at the third measuring point rose to as low as about 30° C.

The power consumption of test sample 210 was 1.23 W. In contrast, the power consumption of test sample 220 was 1.35 W.

From the above-described test results, it was found that the temperature of whole fabric heater 1 according to the present invention rose to 30° C. or higher in a short time period of about 120 seconds after a voltage was applied while the temperature of a heater constituted by carbon fiber did not reach 30° C. It was also found that the power consumption of fabric heater 1 according to the present invention is smaller than that of a heater constituted by carbon fiber.

DESCRIPTION OF THE REFERENCE NUMERALS

1 Fabric heater
2 Fabric
4 Conductive thread
6*a* Conductive line
6*b* Non-conductive line
7 Bunch of lines
10 Core
11 Conductive layer
12 Foil
20 Fiber thread (thread made of fiber)
30 Electrode
31 Electrode thread
35 Electrode thread
36 Connector
40 Electrode
50 DC power source
51 Wiring
52 Connector
100 Lead line

The invention claimed is:

1. A fabric heater, comprising:

a piece of fabric that is formed by twist-braiding a plurality of loop portions with each other, the plurality of loop portions being linked to a conductive thread; and electrodes that are each formed by at least first and second electrode thread on a first surface of the piece of fabric, each of the electrodes being spaced from other electrodes, respectively; wherein the conductive thread has:

a cable core formed by a fiber, and a conductive layer or a conductive foil that covers a surface of the cable core; and the first electrode thread has a first core and a first twisted thread consisting of copper that is wrapped directly around an outer surface of the first core, the first twisted thread being in direct contact with the outer surface of the first core, the second electrode thread has a second core and a second twisted thread consisting of copper that is wrapped directly around an outer surface of the second core, the second twisted thread being in direct contact with the outer surface of the second core, a diameter of the second twisted thread being greater than a diameter of the first twisted thread, and the first electrode thread is knitted on the first surface of the piece of fabric, the second electrode thread penetrates the piece of fabric from a second surface of the piece of fabric opposite to the first surface by braiding the second electrode thread from the second surface, and the knitted first electrode thread directly and electrically comes in contact with the second electrode thread in the first surface of the piece of fabric so that the first electrode thread is stitched on the first surface by using the second electrode thread.

2. The fabric heater according to claim 1, wherein the piece of fabric is formed by an interlock stitch whereby the plurality of loop portions and the conductive thread are twist-braided on only the first surface of the piece of the fabric and a fiber thread only exists on the second surface of the piece of the fabric.

3. The fabric heater according to claim 1, wherein the first electrode thread is braided into the piece of fabric from the first surface of the piece of fabric, the second electrode threads is braided into the piece of fabric from the second surface of the piece of fabric, the first and second electrode threads are only and continuously braided threads with each other to form the electrodes to the piece of fabric, and the braided first and second electrode threads are used as a lead line extending to the outside of the piece of fabric from an edge of the piece of fabric.

4. A fabric heater, comprising:

a piece of fabric that is formed by twist-braiding a plurality of loop portions with each other, the plurality of loop portions being linked to a conductive thread; and electrodes that are each formed by at least first and second electrode threads on a first surface of the piece of fabric, each of the electrodes being spaced from other electrodes, respectively; wherein the first electrode thread has a first core and a first twisted thread consisting of copper that is wrapped directly around an outer surface of the first core, the first twisted thread being in direct contact with the outer surface of the first core, the second electrode thread has a second core and a second twisted thread consisting of copper that is wrapped directly around an outer surface of the second core, the second twisted thread being in direct contact with the outer surface of the second core, a diameter of the second twisted thread being greater than a diameter of the first twisted thread, and the first electrode thread is knitted on the first surface of the piece of fabric, the second electrode thread penetrates the piece of fabric from a second surface of the piece of fabric opposite to the first surface by braiding the second electrode thread from the second surface, and the knitted first electrode thread directly and electrically comes in contact with the second electrode thread in the first surface of the piece of fabric so that the first electrode thread is stitched on the first surface by using the second electrode thread.

5. A fabric heater, comprising:

a piece of fabric that is formed by twist-braiding a plurality of loop portions with each other, the plurality of loop portions being linked to a conductive thread; and electrodes that are each formed by at least first and second electrode threads on a first surface of the piece of fabric, each of the electrodes being spaced from other electrodes, respectively; wherein the first electrode thread has a first core and a first twisted thread consisting of copper that is wrapped directly around an outer surface of the first core, the first twisted thread being in direct contact with the outer surface of the first core, the second electrode thread has a second core and a second twisted thread consisting of copper that is wrapped directly around an outer surface of the second core, the second twisted thread being in direct contact with the outer surface of the second core, a diameter of the second twisted thread being greater than a diameter of the first twisted thread, and the first electrode thread is knitted only on the first surface, the second electrode thread is braided from the second surface and hooks the first electrode thread on the first surface, thereby the knitted first electrode thread is stitched on the first surface by using the second electrode thread.

6. A fabric heater, comprising:

a piece of fabric that is formed by twist-braiding a plurality of loop portions with each other, the plurality of loop portions being linked to a conductive thread; and electrodes that are each formed by at least first and second electrode threads on a first surface of the piece of fabric, each of the electrodes being spaced from other electrodes, respectively; wherein the first electrode thread that has a first core and a first twisted thread consisting of copper around an outer surface of the first core, the second electrode thread that has a second core and a second twisted thread consisting of copper around an outer surface of the second core, a diameter of the second twisted thread being greater than a diameter of the first twisted thread, and the first electrode thread is knitted on the first surface of the piece of fabric, the second electrode thread penetrates the piece of fabric from a second surface of the piece of fabric opposite to the first surface by braiding the second electrode thread from the second surface of the piece of fabric, and the knitted first electrode thread directly and electrically comes in contact with the second electrode thread in the first surface of the piece of fabric so that the first electrode thread is stitched on the first surface by using the second electrode thread.

7. The fabric heater according to claim 4, wherein the piece of fabric is formed by an interlock stitch whereby the plurality of loop portions and the conductive thread are twist-braided on only the first surface of the piece of the fabric and a fiber thread only exists on the second surface of the piece of the fabric.

8. The fabric heater according to claim 5, wherein the piece of fabric is formed by an interlock stitch whereby the plurality of loop portions and the conductive thread are twist-braided on only the first surface of the piece of the fabric and a fiber thread only exists on the second surface of the piece of the fabric.

9. The fabric heater according to claim 6, wherein the piece of fabric is formed by an interlock stitch whereby the plurality of loop portions and the conductive thread are twist-braided on only the first surface of the piece of the fabric and a fiber thread only exists on the second surface of the piece of the fabric.

* * * * *